US005819415A

United States Patent [19]

Bruggers et al.

[11] Patent Number: 5,819,415

[45] Date of Patent: Oct. 13, 1998

[54] HAIR-CUTTING APPARATUS HAVING A TOOTHED CUTTING DEVICE, AND TOOTHED CUTTING DEVICE FOR SUCH AN APPARATUS

[75] Inventors: Jan W. Bruggers, Eindhoven, Netherlands; Stephan Leitner, Kappel, Austria

[73] Assignee: U.S. Philips Corporation, New York, N.Y.

[21] Appl. No.: 841,914

[22] Filed: Apr. 17, 1997

[30] Foreign Application Priority Data

Apr. 26, 1996 [EP] European Pat. Off. ..... 96890078

[51] Int. Cl.[6] ..... B26B 19/02

[52] U.S. Cl. ..... 30/223; 30/210; 30/216

[58] Field of Search ..... 30/208, 209, 210, 30/216, 223, 346.51

[56] References Cited

U.S. PATENT DOCUMENTS 2,174,130 9/1939 Looper ..... 30/223
2,713,718 7/1955 Hudson ..... 30/210
3,132,424 5/1964 Kirkland ..... 30/210
4,531,291 7/1985 Laube ..... 30/216

FOREIGN PATENT DOCUMENTS 1051161 2/1959 Germany .

*Primary Examiner*—Hwei-Siu Payer
*Attorney, Agent, or Firm*—Ernestine C. Bartlett

[57] ABSTRACT

A hair-cutting apparatus (1) is provided having a toothed cutting device (5) comprising a stationary first toothed cutter (6) with a first cutter-tooth row (7) and a second toothed cutter (9) with a second cutter-tooth row (10), which second toothed cutter is drivable so as to reciprocate about a pivotal axis (8), the first cutter-tooth row (7) of the first toothed cutter (6) extends linearly in a first row direction (23) and the second cutter-tooth row (10) of the second toothed cutter (9) comprises two row segments (24, 25) which in a central position of the second toothed cutter (9), starting from a center point (26), diverge with respect to the linear direction of the first cutter-tooth row (7).

8 Claims, 4 Drawing Sheets

HAIR-CUTTING APPARATUS HAVING A TOOTHED CUTTING DEVICE, AND TOOTHED CUTTING DEVICE FOR SUCH AN APPARATUS

FIELD OF THE INVENTION

The invention relates to a hair-cutting apparatus having a toothed cutting device comprising a stationary first toothed cutter with a first cutter-tooth row and a second toothed cutter with a second cutter-tooth row, which second cutter is drivable so as to reciprocate about a pivotal axis from a first reversing position into a second reversing position via a central position and vice versa, a pivoting angle $\alpha$ lying between the two reversing positions, the two bounding lines of said angle corresponding to the two reversing positions and the bisector of said angle corresponding to the central position.

BACKGROUND OF THE INVENTION

A hair-cutting apparatus having a toothed butting device is known, for example, from the German Patentschrift No. DE 1 051 161 C. In this known apparatus and in this known toothed cutting device the rows of cutter teeth of both toothed cutters each have a circular arc shape, the centers of the two arcs coinciding with the pivotal axis of the reciprocatingly drivable second toothed cutter. Owing to the limited space the distance between the pivotal axis of the second toothed cutter and the arc-shaped cutter-tooth rows cannot be selected large enough to obtain cutter-tooth rows with a minimal curvature, as a result of which the two rows of cutter teeth have a comparatively strong curvature. A consequence of this is that in operation a cutting process is, in fact, performed only in an area of the two toothed cutters which is situated near the hairs to be severed, whereas in the remaining area of the two toothed cutters, which owing to the comparatively strong curvature is situated comparatively far away from the hairs to be severed, the cutting process does not proceed satisfactorily or hardly takes place. Moreover, it is to be noted that the manufacture of the two toothed cutters of the known apparatus is comparatively difficult and intricate.

SUMMARY OF THE INVENTION

It is an object of the invention to preclude the above-mentioned problems and to provide an improved hair-cutting apparatus and an improved toothed cutting device, in which always a satisfactory and perfect cutting performance is obtained with both toothed cutters and in which at least one of the two toothed cutters can be manufactured simply.

According to the invention, in order to achieve the above-mentioned object in a hair-cutting apparatus, the first cutter-tooth row extends substantially linearly in a first row direction and the first row direction extends substantially perpendicularly to the bisector of the pivoting angle, and the second cutter-tooth row comprises two row segments, which starting from a center point in the central area of the second cutter-tooth row extend away from the central point in opposite directions and in the central position of the second toothed cutter, starting from the central point, each diverge with respect to the linear orientation of the first row direction, the cutter teeth of a row segment being moved towards the distal side of the cutter teeth of the first cutter-tooth row in each reversing position of the second toothed cutter. In this way it is achieved that in each reversing position of the reciprocatingly drivable second toothed cutter each time one row segment of the second cutter-tooth row of the second toothed cutter and approximately one half of the linear first cutter-tooth row of the stationary first toothed cutter coincide with one another during operation of an apparatus in accordance with the invention, so that ultimately a uniform and perfect cutting performance is achieved over the entire length of the cutter-tooth rows. Furthermore, owing to the measures in accordance with the invention it is achieved that as a result of the similar orientation of the cutter teeth of the stationary first toothed cutter at least this first toothed cutter of an apparatus in accordance with the invention can be manufactured comparatively simply and cheaply.

In an apparatus in accordance with the invention the two row segments of the second cutter-tooth row and, consequently, the second cutter-tooth row as a whole have a circularly arcuate shape, the radius of the arc being substantially greater than the pivoting radius of the second toothed cutter, which essentially corresponds to the distance between the pivotal axis for the second toothed cutter and the center point of the second cutter-tooth row.

However, in preferred embodiments of an apparatus in accordance with the invention, the second cutter-tooth row comprises two row segments which extend substantially linearly in two segment directions, and the two segment directions of the two row segments form an obtuse angle $\beta$ with one another, which angle is essentially defined by the equation $\beta=180°-\alpha$ and in the central position of the second toothed cutter is bisected by the bisector of the pivoting angle $\alpha$. In this way it is achieved that in each reversing position of the reciprocatingly drivable second toothed cutter each time a linear row segment of the second cutter-tooth row of the second toothed cutter is disposed substantially parallel to the linear first cutter-tooth row of the stationary first toothed cutter during operation of such an apparatus in accordance with the invention, so that ultimately a very good cutting performance is achieved over the entire length of the cutter-tooth rows, particularly in the lateral end portions of the cutter-tooth rows. Furthermore, it is achieved that as a result of the similar orientation of the cutter teeth of the drivable toothed cutter for each linear row segment this second toothed cutter can also be manufactured comparatively simply and cheaply.

In an apparatus in accordance with the invention as described hereinbefore the angle $\beta$ can have different values. It is preferred that if the angle $\beta$ have a value in a range between 170° and 178°. This range of values has proved to be very favorable in practice.

A particularly preferred embodiment of an apparatus as described hereinbefore is characterized in that the angle $\beta$ has a value of approximately 174°. In practice, such a value has proved to be particularly favorable.

According to the invention, in order to achieve the above-mentioned further object in a toothed cutting device of the type invention, the first cutter-tooth row extends substantially linearly in a first row direction and the first row direction extends substantially perpendicularly to the bisector of the pivoting angle, and the second cutter-tooth row comprises two row segments, which starting from a center point in the central area of the second cutter-tooth row extend away from the central point in opposite directions and in the central position of the second toothed cutter, starting from the central point, each diverge with respect to the linear orientation of the first row direction, the cutter teeth of a row segment being moved towards the distal side of the cutter teeth of the first cutter-tooth row in each reversing position of the second toothed cutter. In this way it is achieved that in each reversing position of the reciprocatingly drivable second toothed cutter each time one row segment of the second cutter-tooth row of the second toothed cutter and approximately one half of the linear first cutter-tooth row of the stationary first toothed cutter overlie another during operation of a toothed cutting device in accordance with the invention, so that ultimately a uniform and perfect cutting performance can be achieved over the entire length of the cutter-tooth rows. Furthermore, owing to the measures in accordance with the invention it is achieved that as a result of the similar orientation of the cutter teeth of the stationary first toothed cutter at least this first toothed cutter of a toothed cutting device in accordance with the invention can be manufactured comparatively simply and cheaply.

In a toothed cutting device in accordance with the invention the two row segments of the second cutter-tooth row and, consequently, the second cutter-tooth row as a whole can have a circularly arcuate shape, the radius of the arc being substantially greater than the pivoting radius of the second toothed cutter, which essentially corresponds to the distance between the pivotal axis for the second toothed cutter and the center point of the second cutter-tooth row. However, it has proved to be particularly advantageous if in a toothed cutting device in accordance with the invention the second cutter-tooth row comprises two row segments which extend substantially linearly in two segment directions, and the two segment directions of the two row segments form an obtuse angle $\beta$ with one another, which angle is essentially defined by the equation $\beta=180°-\alpha$ and in the central position of the second toothed cutter is bisected by the bisector of the pivoting angle $\alpha$. In this way it is achieved that in each reversing position of the reciprocatingly drivable second toothed cutter each time a linear row segment of the second cutter-tooth row of the second toothed cutter is disposed substantially parallel to the linear first cutter-tooth row of the stationary first toothed cutter during operation of such a toothed cutting device in accordance with the invention, so that ultimately a very good cutting performance is achieved over the entire length of the cutter-tooth rows, particularly in the lateral end portions of the cutter-tooth rows. Furthermore, it is thus achieved that as a result of the similar orientation of the cutter teeth of the drivable toothed cutter for each linear row segment the second toothed cutter can also be manufactured comparatively simply and cheaply.

In a toothed cutting device in accordance with the invention as described hereinbefore the angle $\beta$ can have different values. It is preferred that if the angle $\beta$ has a value in a range between 170° and 178°. This range of values has proved to be very favorable in practice.

A particularly advantageous embodiment of a toothed cutting device as described hereinbefore is characterized in that the angle $\beta$ has a value of approximately 174°. In practice, such a value has proved to be particularly favorable.

The afore-mentioned as well as further aspects of the invention will be apparent from the exemplary embodiments described hereinafter and will be elucidated by means of these exemplary embodiments.

BRIEF DESCRIPTION OF THE DRAWINGS

The invention will now be described in more detail with reference to three exemplary embodiments to which the invention is not limited.

DETAILED DESCRIPTION OF THE PREFERRED EMBODIMENTS

Figure 1:
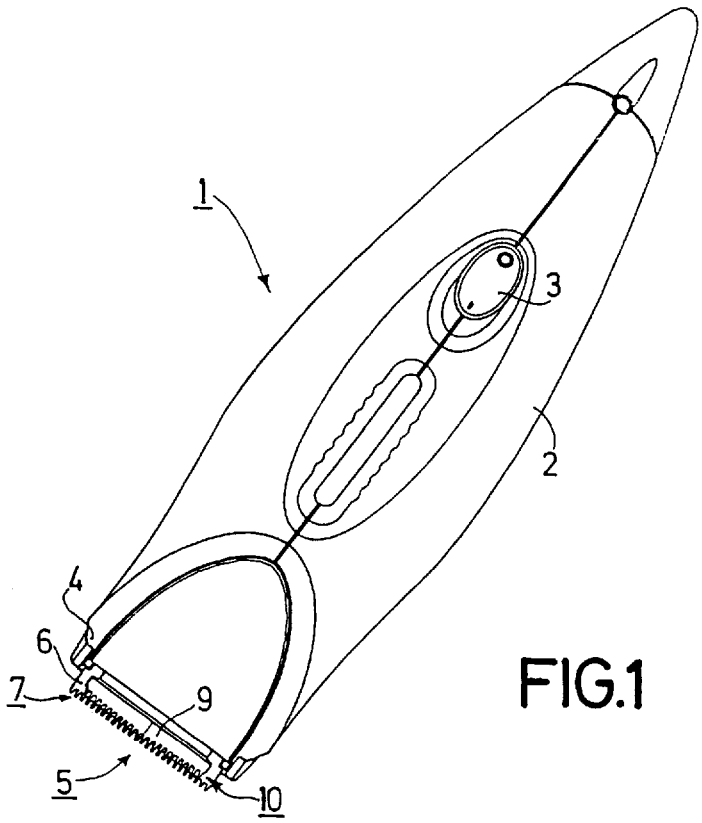
FIG. 1 is an oblique view of a hair-cutting apparatus in accordance with the invention with a toothed cutting device in accordance with a first exemplary embodiment of the invention, comprising a stationary first toothed cutter and a second toothed cutter which is reciprocatingly drivable about a pivotal axis.

FIG. 1 shows a hair-cutting apparatus 1 having a housing 2 provided with an on/off switch 3 for switching on and switching off the hair-cutting apparatus. At the location of an end portion 4 of the housing 2 the hair-cutting apparatus 1 comprises a toothed cutting device 5, which is shown in FIG. 2 in an oblique view to an enlarged scale in comparison with FIG. 1 and in FIGS. 3 to 5 in a highly diagrammatic plan view.

Figure 3:
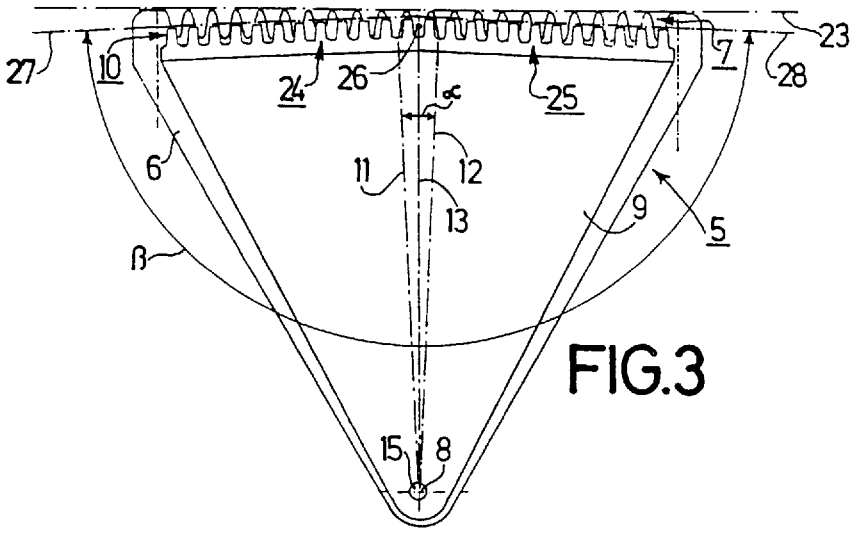
FIG. 3 is a highly diagrammatical plan view of the two toothed cutters of a toothed cutting device as shown in FIG. 2, the reciprocatingly drivable second toothed cutter being in a center position.
Figure 4:
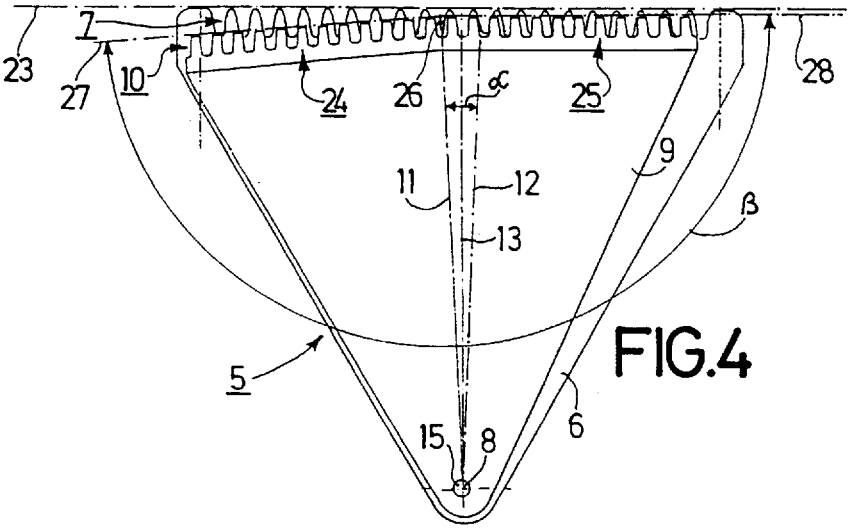
FIG. 4, similarly to FIG. 3, shows the two toothed cutters of the toothed cutting device of FIG. 2, the reciprocatingly drivable toothed cutter being shown in one of its two reversing positions.
Figure 5:
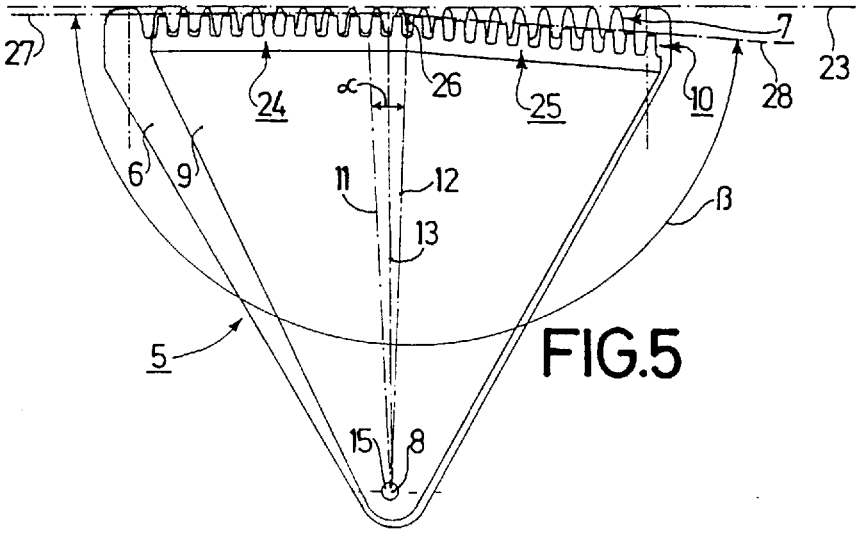
FIG. 5, similarly to FIGS. 3 and 4, shows the two toothed cutters of the toothed cutting device of FIG. 2, the reciprocatingly drivable second toothed cutter being shown in the other one of its two reversing positions.

The toothed cutting device 5 has a stationary first toothed cutter 6 comprising a first cutter-tooth row 7 and a second toothed cutter 9 comprising a second cutter-tooth row 10, which second cutter is drivable so as to reciprocate about a pivotal axis 8 from a first reversing position shown in FIG. 4 into a second reversing position shown in FIG. 5 via a central position shown in FIG. 3 and vice versa. A pivoting angle $\alpha$ lies between the two reversing positions, as is shown in FIGS. 3 to 5, its two bounding lines 11 and 12 corresponding to the two reversing positions and its bisector 13 corresponding to the central position of the reciprocatingly drivable second toothed cutter 9.

Figure 2:
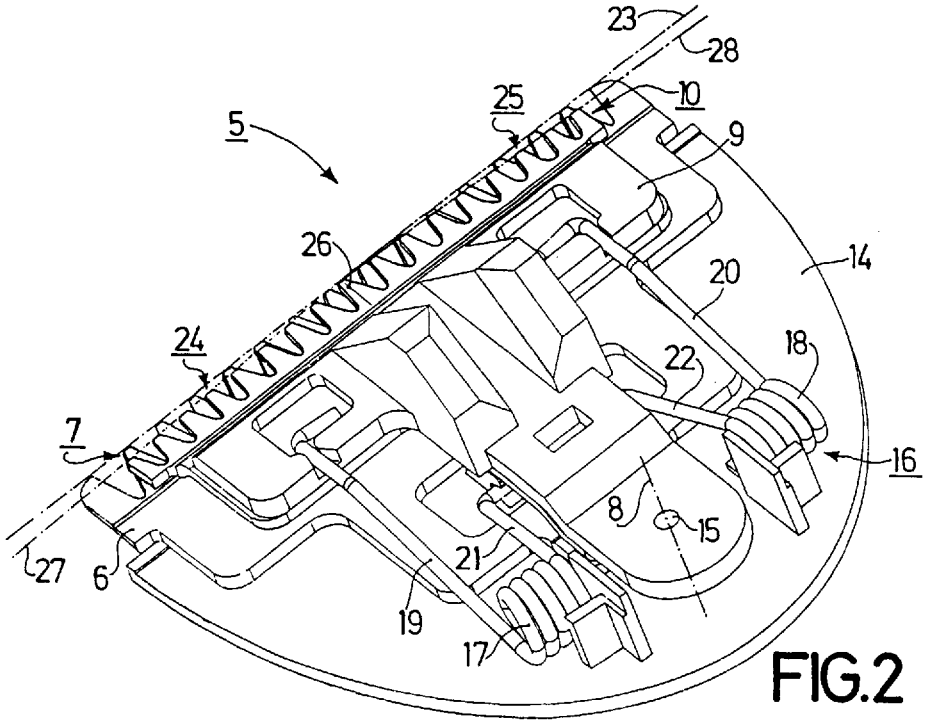
FIG. 2 is an oblique view of the toothed cutting device of the apparatus of FIG. 1, shown to an enlarged scale in comparison with FIG. 1.

As is shown in FIG. 2, the stationary first toothed cutter 6 is mounted on a mounting plate 14 and is secured to the mounting plate 14 in a manner not shown.

Mounting can be effected, for example, by clamping, plugging, welding or gluing. The reciprocatingly drivable second toothed cutter 9 is pivotable about a pin 15 which projects from the mounting plate 14 and which defines the pivotal axis 8. The toothed cutting device 5 further comprises a spring device 16 having two helically wound portions 17 and 18 and limbs 19 and 20 as well as 21 and 22, which project from these portions 17 and 18. The two limbs 21 and 22 act upon the mounting plate 14 and the two limbs 19, 20 act upon the reciprocatingly drivable second toothed cutter 9 so as to urge the reciprocatingly drivable second toothed cutter 9 against the stationary first toothed cutter 6, as a result of which the second cutter-tooth row 10 of the reciprocatingly drivable second toothed cutter 9 is pressed against the first cutter-tooth row 7 of the stationary toothed cutter 6.

As is apparent from FIGS. 1 to 5, the first cutter-tooth row 7 extends substantially linearly in a first row direction 23 indicated by means of a dash-dot line in FIGS. 2 to 5. The first row direction 23 extends substantially perpendicularly to the bisector 13 of the pivoting angle $\alpha$.

As is further apparent from FIGS. 1 to 5, the second cutter-tooth row 10 of the reciprocatingly drivable second toothed cutter 9 comprises two row segments 24 and 25, which starting from a center point 26 in the central area of the second cutter-tooth row 10 extend away from the central point 26 in opposite directions and which in the central position of the second toothed cutter 9 each diverge from the central point 26 with respect to the linear orientation of the first row direction 23 of the first cutter-tooth row 7, the cutter teeth 9 of a row segment 24 or 25 being moved towards the distal side of the cutter teeth of the first cutter-tooth row 7 of the stationary first toothed cutter 6 in each of the two respective reversing positions of the second toothed cutter 9 shown in FIGS. 4 and 5.

As is further apparent from FIGS. 1 to 5, the second cutter-tooth row 10 of the reciprocatingly drivable second toothed cutter 9 comprises two row segments 24 and 25, which each extend substantially linearly in two segment directions 27 and 28, respectively, indicated in dash-dot lines in FIGS. 2 to 5 and forming an obtuse angle $\beta$ with one another, indicated in FIGS. 3 to 5. The angle $\beta$ is defined by the equation $\beta=180°-\alpha$. In the central position of the second toothed cutter 9 shown in FIG. 3 the angle $\beta$ is bisected by the bisector 13 of the pivoting angle $\alpha$. In the hair-cutting apparatus 1 shown in FIG. 1 the angle $\beta$ has a value of approximately 174°. However, the angle $\beta$ may also have a value in a range between 170° and 178°.

As is apparent from FIGS. 3 to 5, the hair-cutting apparatus 1 in FIG. 1 has the advantage that during operation of the hair-cutting apparatus 1 a row segment 24 or 25 of the second cutter-tooth row 10 of the second toothed cutter 9 and approximately one half of the linear first cutter-tooth row 7 of the stationary first toothed cutter 6 coincide in each reversing position of the reciprocatingly drivable second toothed cutter 9, so that ultimately a uniform and perfect cutting performance is achieved over the entire length of the cutter-tooth rows 7 and 10. A further advantage of the hair-cutting apparatus 1 in FIG. 1 is that the cutter teeth of the stationary first toothed cutter 6 and the cutter teeth of the two row segments 24 and 25 of the reciprocatingly drivable second toothed cutter 9 extend in the same direction, which is advantageous in view of a simple and cheap production of the two toothed cutters 6 and 9.

Figure 6:
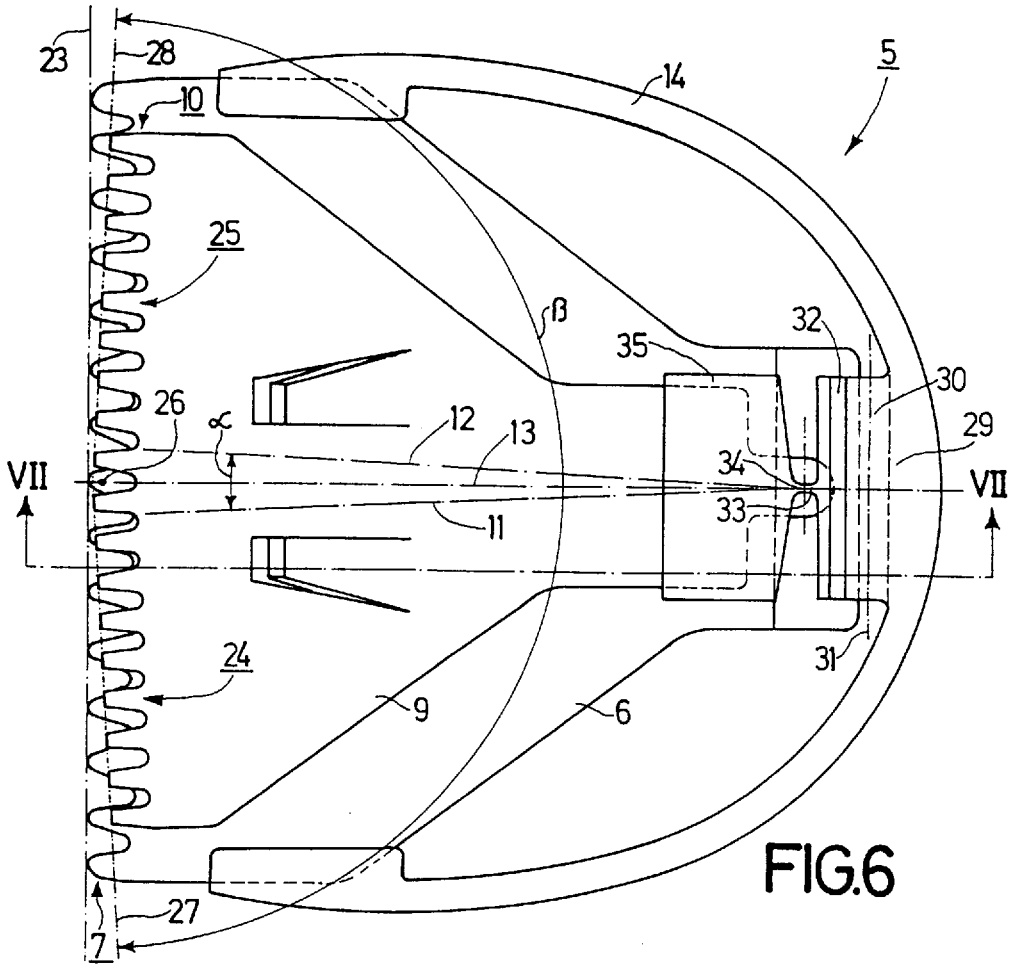
FIG. 6 is a plan view showing a toothed cutting device in accordance with a second exemplary embodiment of the invention.
Figure 7:
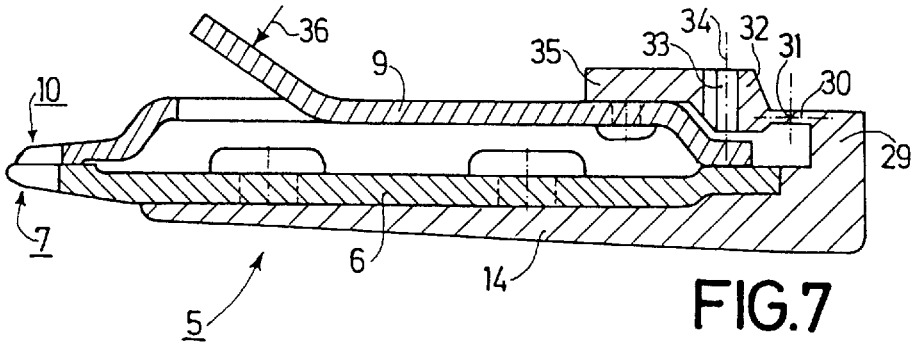
FIG. 7 shows the toothed cutting device of FIG. 6 in a sectional view taken on the line VII—VII in FIG. 6.

FIGS. 6 and 7 shows a further toothed cutting device 5 whose stationary first toothed cutter 6 has a first cutter-tooth row 7 which extends linearly in a first row direction 23 and whose reciprocatingly drivable second toothed cutter 9 has a second cutter-tooth row 10 which comprises two row segments 24 and 25 which extend linearly in two segment directions 27 and 28.

In the toothed cutting device 5 shown in FIGS. 6 and 7 the stationary first toothed cutter 6 is mounted on a mounting plate 14 having a projecting block 29 in its area which is remote from the cutter-tooth rows 7 and 10. A first integral hinge 30, whose hinge axis 31 extends substantially parallel to the row direction 23 of the first cutter-tooth row 7, connects the block 29 to an intermediate part 32, which is pivotally connected to a holding member 35 by means of a second integral hinge 33, whose hinge axis 34 extends substantially perpendicularly to the mounting plate 14. The holding member 35 carries the reciprocatingly drivable second toothed cutter 9. Spring means, represented symbolically as an arrow 36 in FIG. 7, act upon the second toothed cutter 9 to urge the reciprocatingly drivable second toothed cutter 9 with its cutter-tooth row 10 against the cutter-tooth row 7 of the stationary toothed cutter 6.

Thus, in the toothed cutting device shown in FIGS. 6 and 7 the hinge axis for the reciprocatingly drivable second toothed cutter 9 is formed by means of the second integral hinge 33. The provision of the first integral hinge 30 in the toothed cutting device 5 shown in FIGS. 6 and 7 simply enables the reciprocatingly drivable second toothed utter 9 to be tilted away against the force of the symbolically shown spring means 36, for example to effect a cleaning operation, particularly in the area of the cutter-tooth rows 7 and 10.

Figure 8:
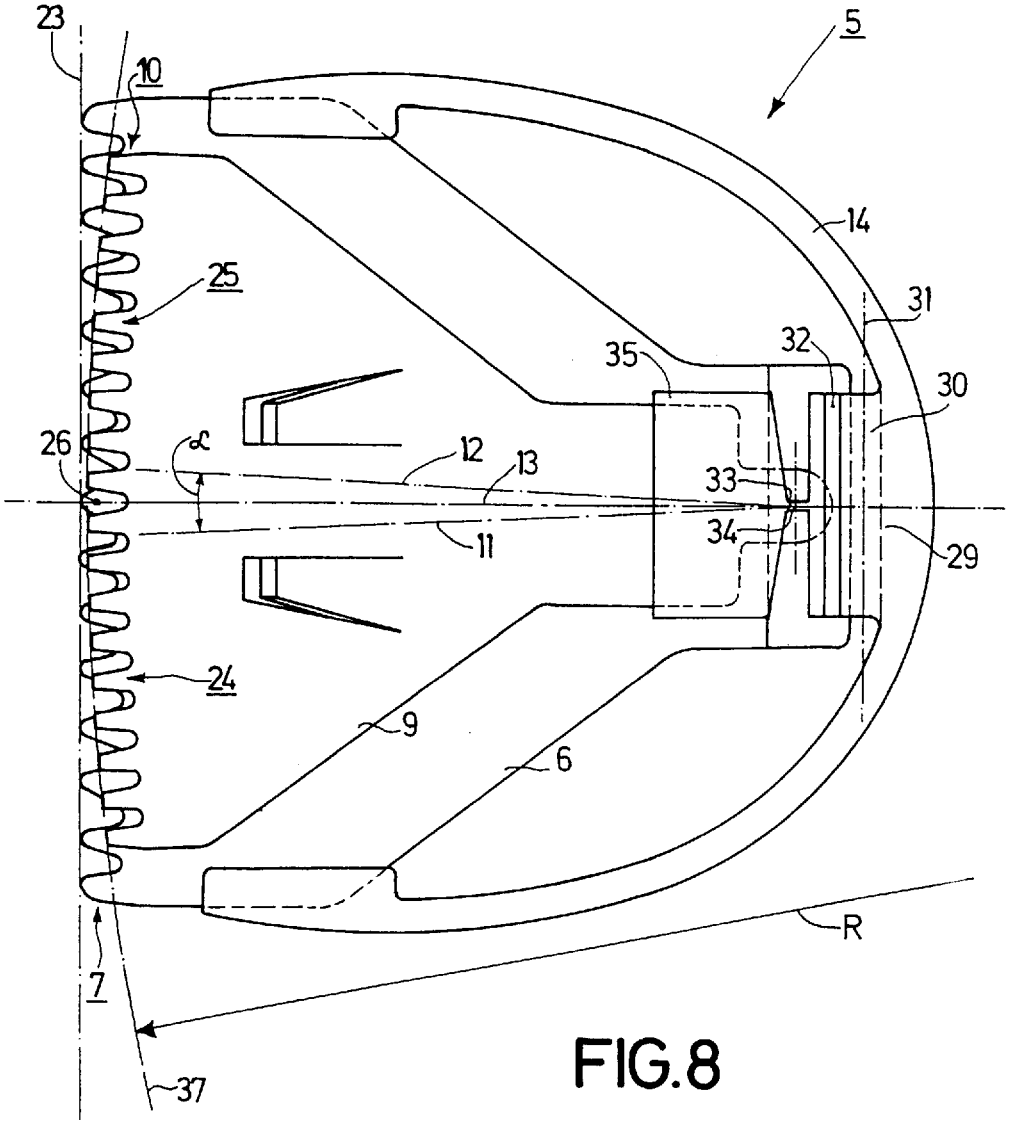
FIG. 8, similarly to FIG. 6, shows a toothed cutting device in accordance with a third exemplary embodiment of the invention.

FIG. 8 shows a further toothed cutting device 5 whose characteristic feature is that the reciprocatingly drivable second toothed cutter 9 comprises a cutter-tooth row 10 whose two row segments 24 and 25 each have a circularly arcuate shape indicated by a dash-dot line 37 in FIG. 8. The circularly arcuate shape 37 corresponds to a radius, indicated by an arrow R in FIG. 8, which is substantially greater than the pivoting radius of the reciprocatingly drivable second toothed cutter 9, which pivoting radius corresponds to the distance between the pivotal axis 34 of the second toothed cutter 9 and the center point 26 of the second toothed cutter 9. As a result of the great difference between the radius R and the pivoting radius of the reciprocatingly drivable second toothed cutter 9, the toothed cutting device 5 shown in FIG. 8 also has the advantage that during operation of this toothed cutting device 5 in an apparatus a row segment 24 or 25 of the second cutter-tooth row 10 of the second toothed cutter 9 and approximately one half of the linear first cutter-tooth row 7 of the stationary first toothed cutter 6 coincide in each reversing position of the reciprocatingly drivable second toothed cutter 9, so that ultimately a uniform and perfect cutting performance is achieved over the entire length of the cutter-tooth rows 7 and 10.

We claim:

1. A hair cutting apparatus having a toothed cutting device comprising a stationary first toothed cutter with a first cutter-tooth row and a second toothed cutter with a second cutter-tooth row, which second cutter is drivable so as to reciprocate about a pivotal axis from a first reversing position into a second reversing position via a central position and vice versa, a pivoting angle $\alpha$ lying between the two reversing positions, the two bounding lines of said angle corresponding to the two reversing positions and the bisector of said angle corresponding to the central position, wherein the first cutter-tooth row extends substantially linearly in a first row direction and the first row direction extends substantially perpendicularly to the bisector of the pivoting angle, and the second cutter-tooth row comprises two row segments, which starting from a center point in the central area of the second cutter-tooth row extend away from the central point in opposite directions and in the central position of the second toothed cutter, starting from the central point, each diverge with respect to the linear orientation of the first row direction, the cutter teeth of at least one of said two row segments being moved towards the distal side of the cutter teeth of the first cutter-tooth row in each reversing position of the second toothed cutter.

2. An apparatus as claimed in claim 1, wherein said two row segments extend substantially linearly in two segment directions, and the two segment directions of the two row segments form an obtuse angle β with one another, which angle is essentially defined by the equation $\beta=180°-\alpha$ and in the central position of the second toothed cutter is bisected by the bisector of the pivoting angle α.

3. An apparatus as claimed in claim 2, wherein the angle β has a value in a range between 170° and 178°.

4. An apparatus as claimed in claim 3, wherein the angle β has a value of approximately 174°.

5. A toothed cutting device for a hair-cutting apparatus, comprising a stationary first toothed cutter with a first cutter-tooth row and a second toothed cutter with a second cutter-tooth row, which second cutter is drivable so as to reciprocate about a pivotal axis from a first reversing position into a second reversing position via a central position and vice versa, a pivoting angle α lying between the two reversing positions, the two bounding lines of said angle corresponding to the two reversing positions and the bisector of said angle corresponding to the central position, wherein the first cutter-tooth row extends substantially linearly in a first row direction and the first row direction extends substantially perpendicularly to the bisector of the pivoting angle, and the second cutter-tooth row comprises two row segments, which starting from a center point in the central area of the second cutter-tooth row extend away from the central point in opposite directions and in the central position of the second toothed cutter, starting from the central point, each diverge with respect to the linear orientation of the first row direction, the cutter teeth of at least one of said two row segments being moved towards the distal side of the cutter teeth of the first cutter-tooth row in each reversing position of the second toothed cutter.

6. A toothed cutting device as claimed in claim 5, wherein said two row segments extend substantially linearly in two segment directions, and the two segment directions of the two row segments form an obtuse angle β with one another, which angle is essentially defined by the equation $\beta=180°-\alpha$ and in the central position of the second toothed cutter is bisected by the bisector of the pivoting angle α.

7. A toothed cutting device as claimed in claim 6, wherein the angle β has a value in a range between 170° and 178°.

8. A toothed cutting device as claimed in claim 7, wherein the angle β has a value of approximately 174°.

* * * * *